US009422645B2

(12) United States Patent
Hubert et al.

(10) Patent No.: US 9,422,645 B2
(45) Date of Patent: Aug. 23, 2016

(54) DEVICE FOR TREATING A THREAD

(75) Inventors: Christian Hubert, Neumünster (DE); Claus Matthies, Ehndorf (DE); Jan Westphal, Schülp (DE)

(73) Assignee: Oerlikon Textile GmbH & Co. KG

( * ) Notice: Subject to any disclaimer, the term of this patent is extended or adjusted under 35 U.S.C. 154(b) by 283 days.

(21) Appl. No.: 14/343,229

(22) PCT Filed: Apr. 23, 2012

(86) PCT No.: PCT/EP2012/057384

§ 371 (c)(1),
(2), (4) Date: May 20, 2014

(87) PCT Pub. No.: WO2013/034318

PCT Pub. Date: Mar. 14, 2013

(65) Prior Publication Data

US 2014/0366349 A1 Dec. 18, 2014

(30) Foreign Application Priority Data

Sep. 9, 2011 (DE) ..... 10 2011 113 178

(51) Int. Cl.
*D02G 1/16* (2006.01)
*D02J 1/08* (2006.01)
*B65H 51/16* (2006.01)

(52) U.S. Cl.
CPC ..... *D02G 1/161* (2013.01); *B65H 51/16* (2013.01); *D02G 1/16* (2013.01); *D02J 1/08* (2013.01); *B65H 2601/521* (2013.01); *B65H 2701/313* (2013.01)

(58) Field of Classification Search
CPC ..... D02G 1/008; D02G 1/024; D02G 1/16; D02G 1/162; D02G 1/161; D02G 1/006; D02G 1/164; D02G 1/167; D02G 1/168; D02J 1/06; D02J 1/08; D06B 19/0035; D06B 19/0017; D06B 19/0052; D06B 23/16; D06B 23/18; B65H 51/16; B65H 2601/521; B65H 2701/313
USPC ..... 28/252, 276, 274, 275, 220, 248, 268, 28/273, 283, 271, 272; 57/908, 350, 289, 57/293; 68/5 C, 5 D, 5 E
See application file for complete search history.

(56) References Cited

U.S. PATENT DOCUMENTS 3,394,440 A * 7/1968 Van Holten ..... D02J 1/08 28/272
3,606,689 A * 9/1971 Matsuo ..... D01D 10/0481 28/220

(Continued)

FOREIGN PATENT DOCUMENTS

CN 101765683 A 6/2010
DE 4113962 A1 11/1991

(Continued)

*Primary Examiner* — Amy Vanatta
(74) *Attorney, Agent, or Firm* — BainwoodHuang

(57) ABSTRACT

A device treats a thread with compressed air. To this end, the device has an intermingling device which is encapsulated in a housing with respect to the environment. For thread guidance, the housing has a thread inlet and an opposite thread outlet. In order to prevent direct transmission of noise through the thread inlet and the thread outlet, the thread inlet and/or the thread outlet is formed in each case by two separate opening slots in quick succession and a thread guiding member between the opening slots.

16 Claims, 6 Drawing Sheets

(56) References Cited

U.S. PATENT DOCUMENTS

Figure 1:
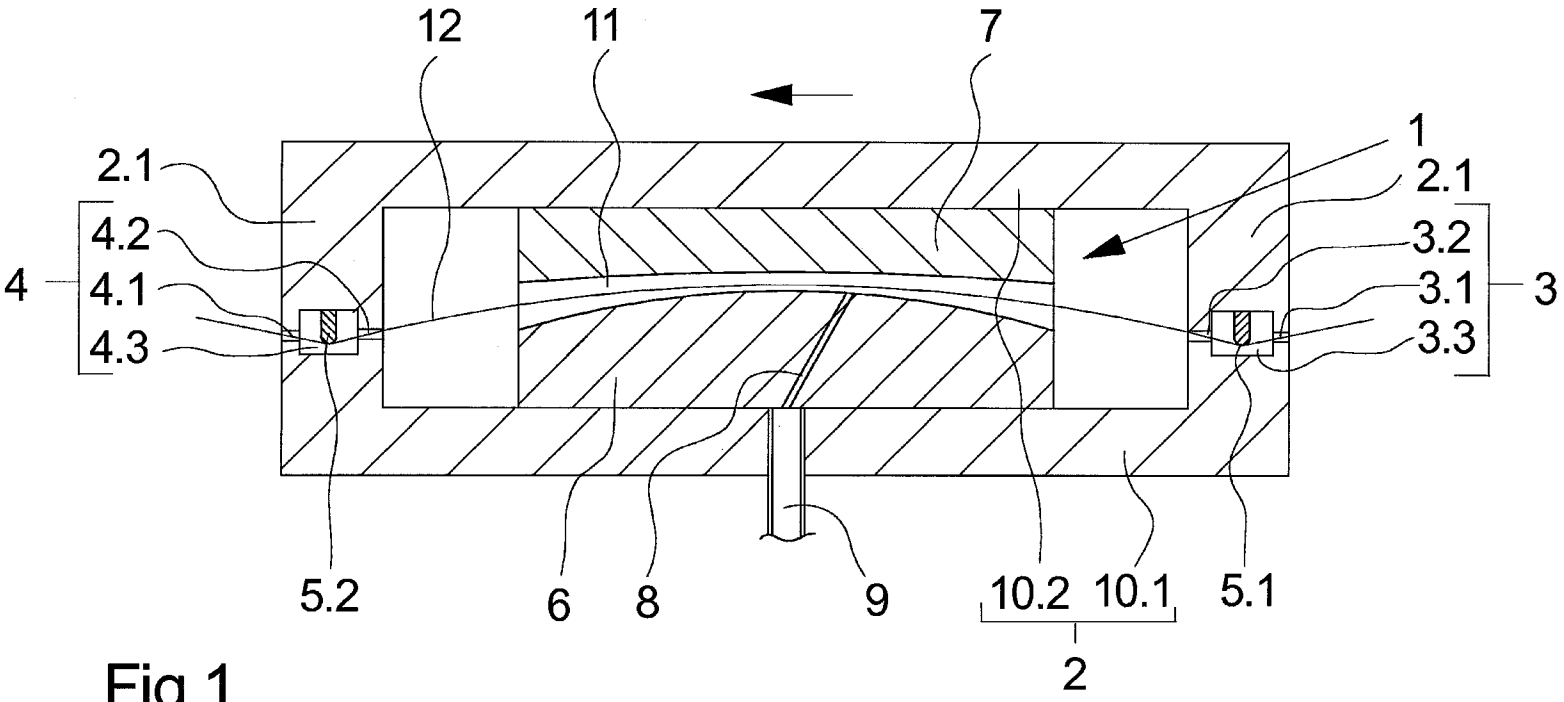

| | | | | | |
|---|---|---|---|---|---|
| 5,134,840 | A * | 8/1992 | Niederer | D02G 1/162 | 57/204 |
| 5,146,660 | A * | 9/1992 | Ritter | D02J 1/08 | 28/271 |
| 5,173,752 | A | 12/1992 | Motonami et al. | | |
| 5,970,593 | A * | 10/1999 | Sear | D02G 1/161 | 28/272 |
| 6,112,387 | A * | 9/2000 | Hinchliffe | D02G 1/16 | 28/274 |
| 6,139,588 | A * | 10/2000 | Foster | D06B 3/04 | 68/5 D |
| 6,735,934 | B1 * | 5/2004 | Wabra | D02G 1/0273 | 57/284 |
| 7,020,940 | B2 * | 4/2006 | Foster | D02G 1/161 | 28/271 |
| 2005/0081335 | A1 * | 4/2005 | Brenk | D02J 13/001 | 19/150 |
| 2005/0102764 | A1 * | 5/2005 | Brenk | D06B 23/18 | 8/149.3 |
| 2010/0257710 | A1 * | 10/2010 | Stundl | D02J 1/08 | 28/217 |
| 2011/0283748 | A1 * | 11/2011 | Brenk | D02J 13/001 | 68/5 E |
| 2013/0186152 | A1 * | 7/2013 | Brenk | D02J 13/001 | 68/5 C |
| 2013/0340207 | A1 * | 12/2013 | Mizutori | D02J 13/00 | 19/66 R |

FOREIGN PATENT DOCUMENTS

| | | | | |
|---|---|---|---|---|
| DE | 4113926 | A1 | 11/1992 | |
| DE | 4140469 | A1 * | 6/1993 | D02J 1/08 |
| EP | 0465407 | A1 | 1/1992 | |
| EP | 0976856 | A1 | 2/2000 | |
| JP | 56148932 | A | 11/1981 | |
| JP | 01290908 | A | 11/1989 | |
| JP | 2003239420 | A | 8/2003 | |
| JP | 2004143963 | A | 5/2004 | |
| JP | 2010534284 | A | 11/2010 | |
| WO | 2009013107 | A2 | 1/2009 | |

* cited by examiner

DEVICE FOR TREATING A THREAD

The invention relates to an apparatus for treatment of a thread with compressed air as disclosed herein.

An apparatus of the stated type, for treatment of a thread with compressed air, is known from DE 41 13 926 A1.

In the production and further processing of synthetic threads that are formed from a plurality of ultra-fine filament strands, it is usual to apply a stream of compressed air to the filament strands within the thread, so that blending of the filaments occurs, going as far as the formation of interweaving knots in the filaments. The treatment takes place in a turbulence device that has a treatment channel for guiding the thread, into which channel a nozzle opening for introduction of the compressed air stream opens. More or less loud noises occur as a function of the production of the compressed air stream, the pressure level, and the thread guidance, and these lead to stress on the operating personnel working in the surroundings.

The known apparatus has a housing to insulate noise, in which housing the turbulence device is held encapsulated with regard to the surroundings. The thread can be fed in through a thread inlet and an opposite thread outlet in the housing of the turbulence device.

In the known apparatus, it has now been shown that the openings of the thread inlet and of the thread outlet caused significant noise transmission in the direction of the surroundings. For example, the thread inlet and the thread outlet usually lie in a thread path plane in which the treatment channel of the turbulence device extends. Transmission of the noises caused by the compressed air and the thread guidance occurs in that they exit from the housing openings of the thread inlet and of the thread outlet without hindrance, as airborne noise.

It is therefore the task of the invention to configure an apparatus for treatment of a thread in such a manner that if at all possible, no direct transmission of sound through the housing openings of the thread inlet and the thread outlet is made possible, without hindering the thread path.

This task is accomplished, according to the invention, in that the thread inlet and/or the thread outlet are formed, in each instance, by means of two consecutive, separate opening slots and a thread guide element between the opening slots.

Advantageous further developments of the invention are defined by the characteristics and combinations of characteristics as disclosed herein.

The invention possesses the particular advantage that the waves of airborne sound caused in the interior by the turbulence device are broken and in part reflected at the thread inlet and/or the thread outlet. Direct passage of the waves of airborne sound is prevented by a thread guide element disposed between the separate opening slots.

The opening slots are preferably configured directly in the housing wall, where a recess is provided between the opening slots, in which the thread guide element is fixed in place. In this way, the opening slots can be configured with low opening cross-sections, independent of the respective thread guide element, which allows contact-free guidance of the thread solely by means of the thread guide element.

The opening slots can be configured symmetrically or asymmetrically relative to the thread guide element.

The further development of the invention in which the opening slots and the thread guide element are disposed offset from one another in such a manner that a thread is guided with a partial loop around the thread guide element is particularly advantageous. In this way, additional interference locations for breaking and reflecting the waves of airborne sound within the thread inlet and/or the thread outlet can be implemented.

In order to obtain the most compact arrangement possible, the further development of the invention in which thread guide elements assigned to the thread inlet and the thread outlet are assigned directly to the turbulence device, as an incoming thread guide and an outgoing thread guide, has proven itself. In this way, multiple functions can be implemented directly by the thread inlet and the thread outlet of the housing. The thread guide elements integrated into the housing thereby simultaneously form the clamped thread length during turbulence action on the thread.

For handling of the turbulence device, the further development of the invention in which the turbulence device is disposed to project from a support, and in which the housing is open on one side and encloses the turbulence device on the support, in the manner of a hood, has proven itself. With this, the possibility exists of using one-piece housings for encapsulating the turbulence device.

The further development of the invention in which the housing is guided on the support in displaceable manner and in which the opening slots and the recess in the housing wall are open toward a face end that faces the support, where the thread guide element that is disposed on the support can be inserted into the recess in the housing wall, offers the particular advantage that no complicated threading and lay-down procedures of the thread are required at the beginning of the process. Thus, the thread guide elements can already be used outside of the housing to allow the thread to be laid down into the turbulence device. By means of the opening slots and recesses of the housing wall that are open toward the face end, the thread can be automatically introduced into the opening slots, to a thread guide element, during guidance, by means of a displacement of the housing.

This variant of the invention is particularly combined with the further development in which two thread guide elements assigned to the thread inlet and the thread outlet of the housing are held on the support.

In order to prevent exiting of compressed air and exiting of the waves of airborne sound at the face end of the housing, it is furthermore provided that a sealing groove for sealing the housing is assigned to the face end of the housing, on the support.

It is advantageous if the sealing groove has an inflatable seal that can be filled with compressed air in an operating position of the housing and can be braced between the support and the housing. In this way, not only a seal but at the same time bracing of the housing on the support is implemented. Undesirable opening caused by compressed air losses in the interior of the housing is prevented.

In order to ensure that the turbulence device can be operated only when the housing is closed, it is furthermore provided that a contact sensor is disposed on the support, which sensor interacts with the housing in the operating position and is connected with a control device. In this way, release of the compressed air can be set by way of the control device, for example.

To implement particularly gentle thread guidance at the thread inlet and the thread outlet, the further development of the invention in which the thread guide element is formed by a deflection roller or a deflection pin is preferably used. Thus, low-friction thread deflections can be made possible both at the thread inlet and at the thread outlet.

In the treatment of the thread with compressed air, it is generally known that the turbulence device gives off a continuous amount of air to the surroundings, by way of the treatment channel. Therefore the further development of the invention in which a suction opening is assigned to the turbulence device within the housing, which opening can be connected with a suction device, is particularly advantageous. In this way, an essentially uniform ambient condition can be implemented, so that excess air can be continuously conducted away from the interior of the housing.

In order to improve the sound-insulating effect of the housing, it is furthermore provided that the housing has a lining of an insulating material on the inside.

The apparatus according to the invention can be used to particular advantage in the variant in which the turbulence device has a driven nozzle ring that has at least one nozzle bore in a circumferential guide groove, which bore can be periodically connected with a compressed air feed and interacts with a stationary cover to form a treatment channel. Such rotationally driven nozzle rings are particularly suitable for producing a high number of interweaving knots at relatively high thread movement speeds. The noise emissions that occur in this connection can be advantageously insulated, with regard to the surroundings, by means of the housing.

The apparatus according to the invention will now be explained in greater detail in the following, using some exemplary embodiments and making reference to the attached figures.

Figure 2:
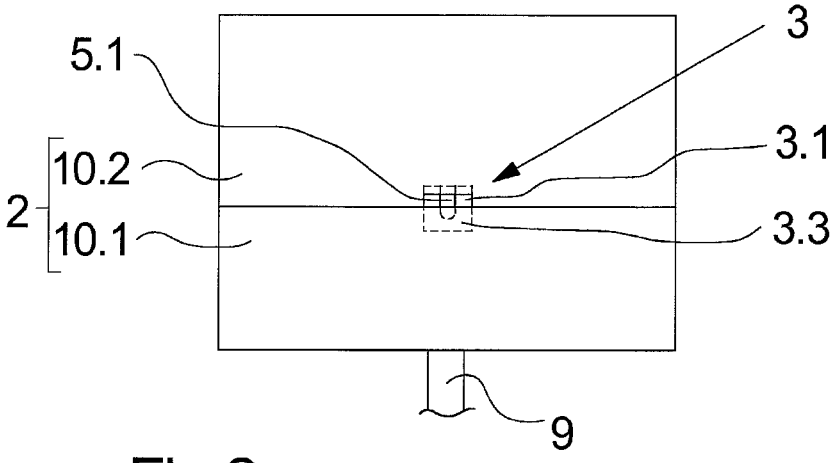
Figure 3:
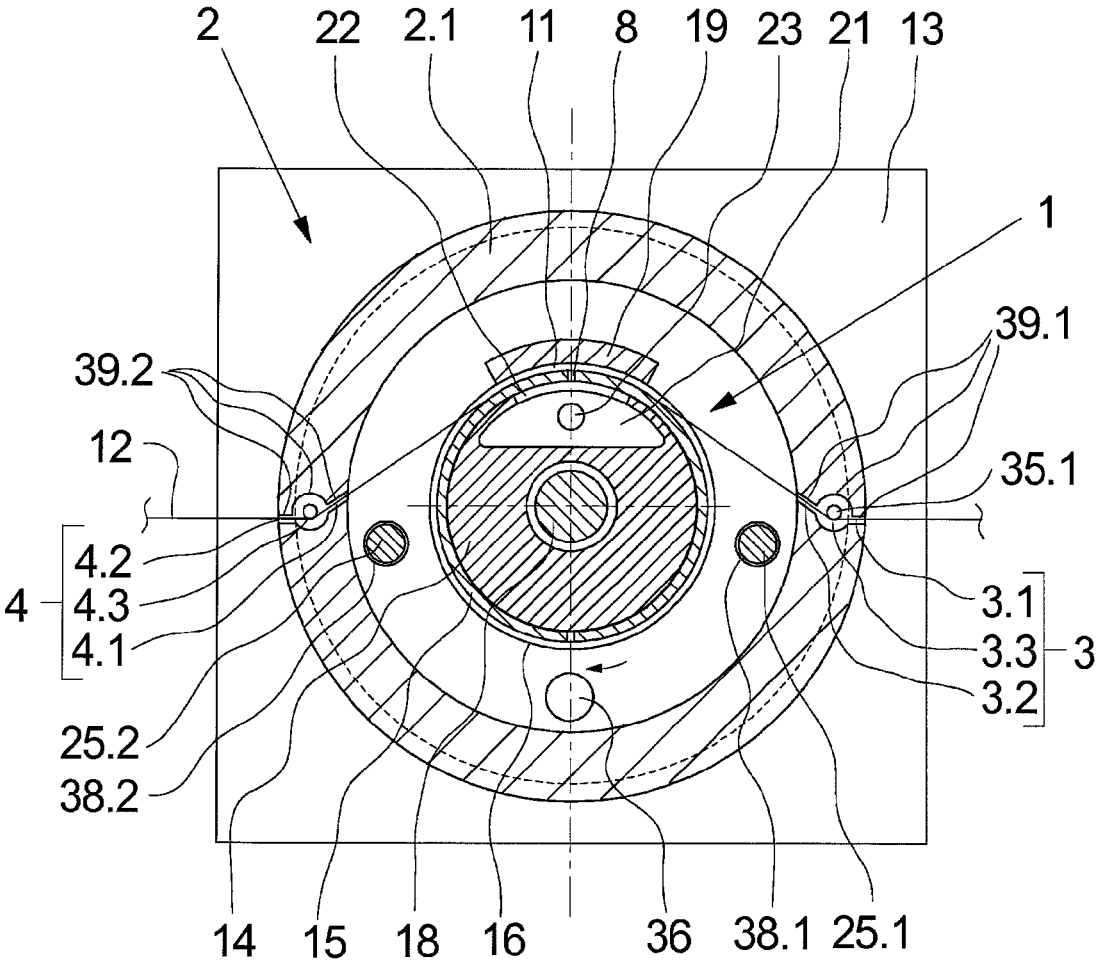
Figure 4:
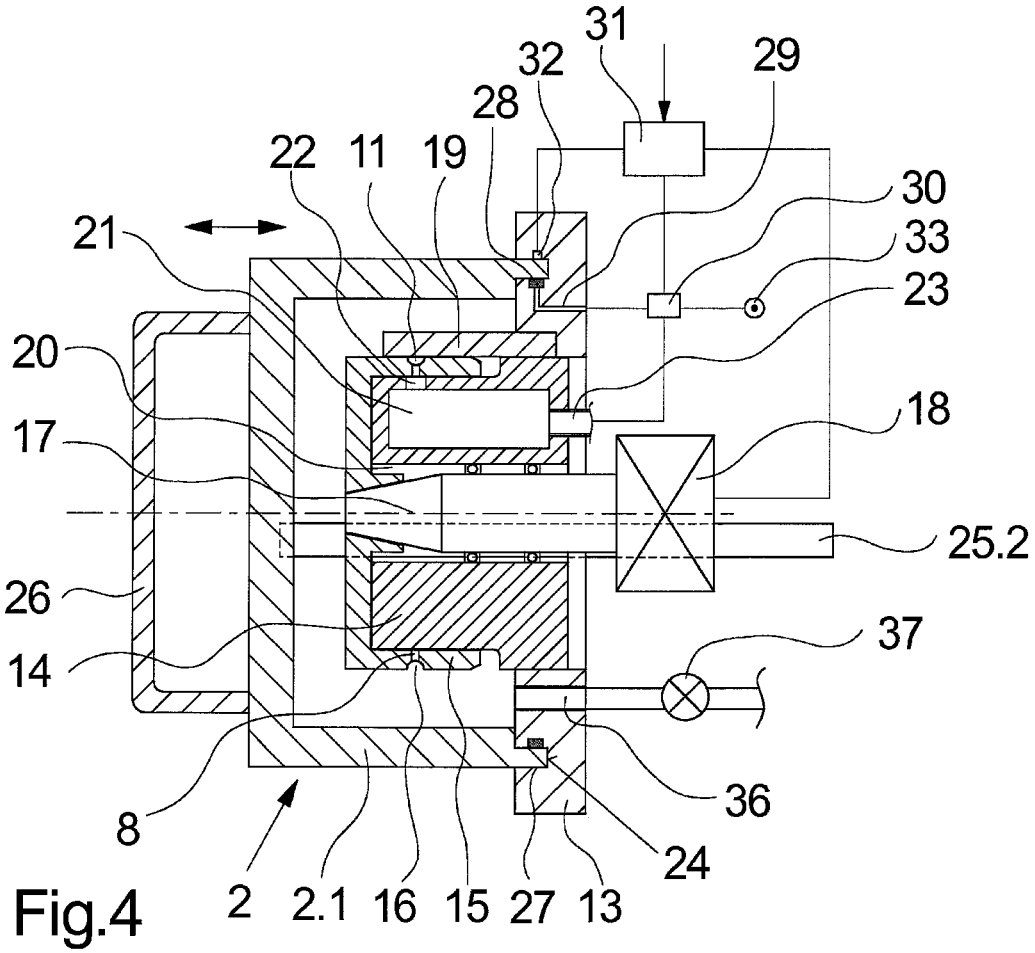
Figure 5:
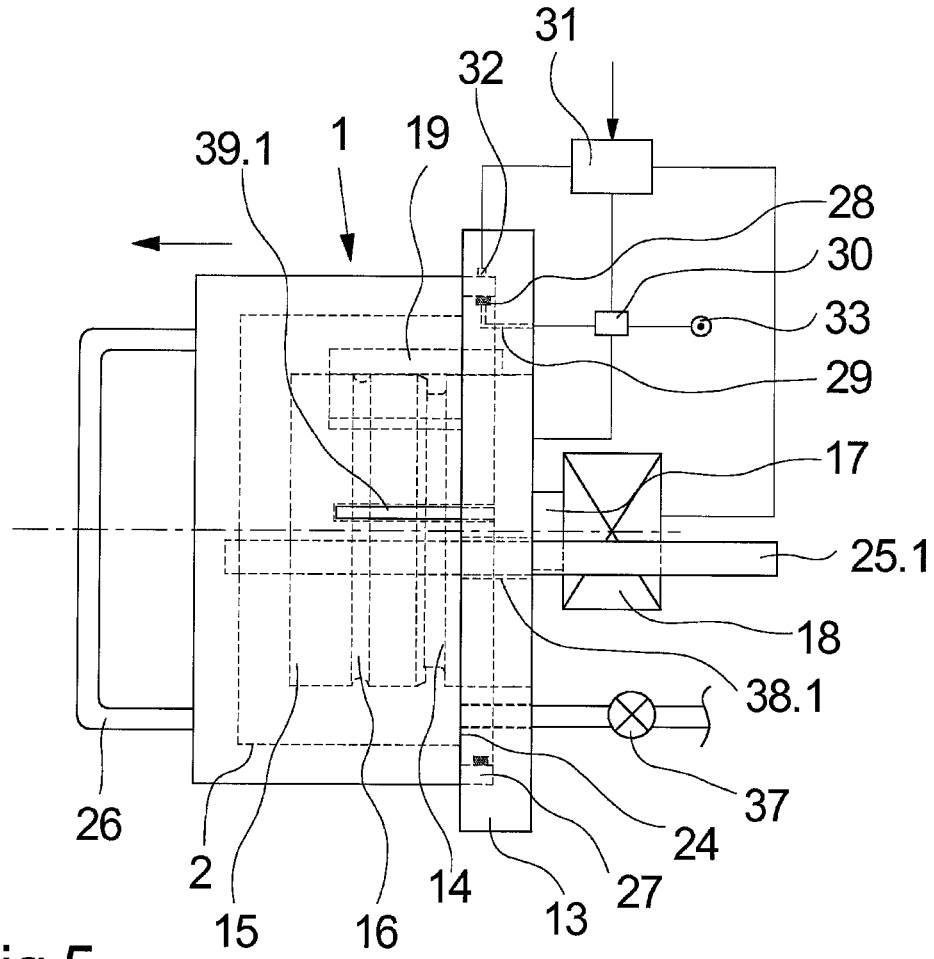
Figure 6:
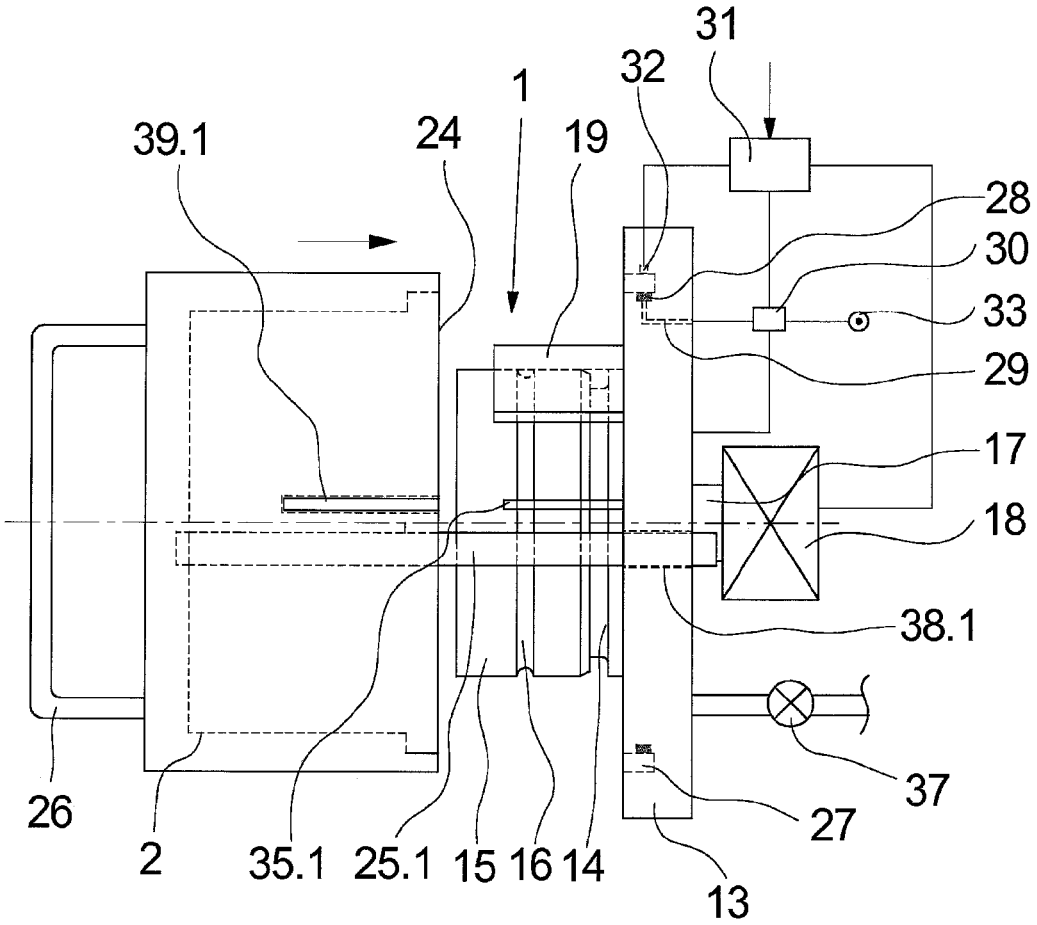

In the Drawings:

FIG. 1 schematically, a cross-sectional view of a first exemplary embodiment of the apparatus according to the invention, FIG. 2 schematically, a side view of the exemplary embodiment from FIG. 1, FIG. 3 schematically, a cross-sectional view of a further exemplary embodiment of the apparatus according to the invention, FIG. 4 schematically, a longitudinal sectional view of the exemplary embodiment from FIG. 3, FIG. 5 schematically, a side view of the exemplary embodiment in FIG. 3 in the operating position, FIG. 6 schematically, a side view of the exemplary embodiment from FIG. 3 in a lay-down position.

In FIGS. 1 and 2, a first exemplary embodiment of the apparatus according to the invention, for treatment of a thread with compressed air, is shown. In FIG. 1, a cross-sectional view is shown, and in FIG. 2, a side view of the exemplary embodiment is shown. The following description applies to both figures, unless an explicit reference is made to one of the figures.

The exemplary embodiment consists of a housing 2 that has a turbulence device 1 in its interior. The housing 2 is formed from two housing halves 10.1 and 10.2, which are held on one another, forming a seal, and form a thread inlet 2 and a thread outlet 4 opposite one another, in their parting line.

The turbulence device 1 is disposed within the housing 2; in this exemplary embodiment, it is formed by a nozzle plate 6 and a baffle plate 7, which form a treatment channel 11 between them. The treatment channel 11 is open at the ends of the baffle plate 7 and the nozzle plate 6, and lies in a thread path plane with the thread inlet 3 and the thread outlet 4. For a better understanding, the thread path of a thread 12 is shown in FIG. 1.

As is evident from the representation in FIG. 1, a nozzle channel 8 opens into the treatment channel 1. The nozzle channel 8 is coupled with a compressed air connector 9 at the bottom of the nozzle plate 6, which connector is configured on the lower housing half 10.1. The nozzle plate 6 is firmly connected with the housing half 10.1, and the baffle plate 7 is firmly connected with the upper housing half 10.2.

As is evident from the representation in FIG. 1, the thread inlet 3 and the thread outlet 4 are structured identically in this exemplary embodiment. Thus, the thread inlet 3 is formed by two opening slots 3.1 and 3.2 that follow one another in the housing wall 2.1. The openings slots 3.1 and 3.2 enclose a recess 3.3 between them. The opening slot 3.1 forms the connection to the outer surroundings. The opening slot 3.2 opens into the interior of the housing and represents the connection between the recess 3.3 and the housing interior.

A thread guide element 5.1 is disposed within the recess 3.3 and extends, with a free end, into the recess 3.3 in such a manner that an imaginary connecting line between the opening slots 3.1 and 3.2 is interrupted by the thread guide element 5.1. In this regard, it is not possible to look through the housing wall 2.1 from the outside to the inside.

On the opposite side of the turbulence device 1, the thread outlet 4 is formed by the opening slots 4.1 and 4.2 in the housing 2, which open into a central recess 4.3 within the housing wall 2.1. Within the recess 4.3, a further thread guide element 5.2 is disposed, which projects, with a free end, into the recess 4.3, in such a manner that no straight-line thread guidance between the opening slots 4.1 and 4.2 is possible. The opening slots 4.1 and 4.2 are configured symmetrically to the recess 4.3.

In the exemplary embodiment shown in FIGS. 1 and 2, the thread inlet 3 and the thread outlet 4 are configured in the parting line between the housing halves 10.1 and 10.2. Thus, the recesses 3.3 and 4.3 can be structured by means of groove-shaped notches in the housing walls of the housing halves 10.1 and 10.2, where the thread guide elements 5.1 and 5.2 are attached on the upper housing half 10.2, within the recesses 3.3 and 4.3, and project into the opposite half of the recesses 3.3 and 4.3 in the closed state of the housing 2. Thereby a thread 12 can be laid directly against the turbulence device in the open state of the housing 2. When the housing 2 is closed, the thread 12 is automatically guided into a guide position desired for the treatment of the thread, by way of the thread guide elements 5.1 and 5.2. This situation is shown in FIG. 1.

In operation, compressed air, which is directed into the treatment channel 11, at the thread 12, as a compressed air stream, by way of the nozzle channel 8, is supplied to the nozzle channel 8 by way of the compressed air connector 9. The thread guide elements 5.1 and 5.2 form the clamped thread length required for the turbulence action, in this connection, and thereby act as the incoming thread guide and outgoing thread guide of the turbulence device 1.

The noises that occur in the interior of the housing 2, during operation and treatment of the thread by the turbulence device, spread out in the interior of the housing by means of sound waves that are transmitted to the surroundings as structure-borne sound and air-borne sound. The structure-borne sound of the plates 6 and 7 in the interior of the housing 2 is usually damped by means of corresponding insulation materials on the interior region of the housing 2. The direct transmission of air-borne sound from the housing interior to the surroundings is significantly damped by means of the configuration of the thread inlet 3 and the thread outlet 4 according to the invention. Thus, the sound waves are reflected and broken by the thread guide organs 5.1 and 5.2 held between the opening slots 3.1 and 3.2 as well as 4.1 and 4.2. In this way, the transmission of air-borne sound to the outer surroundings is significantly reduced. The thread guide elements 5.1 and 5.2 can be formed by plates, in this exemplary embodiment, which have ceramic at a thread guide edge and have insulation materials on their side walls. In this way, the sound waves can be advantageously damped by means of the thread guide elements 5.1 and 5.2.

In FIGS. 3 to 6, a further exemplary embodiment of the apparatus according to the invention, for treatment of a thread with compressed air, is shown. FIG. 3 shows the exemplary embodiment in a cross-sectional view, and FIG. 4 shows it in a longitudinal sectional view. In FIGS. 5 and 6, the exemplary embodiment is shown in a side view, with the housing closed and open.

Unless an explicit reference is made to one of the figures, the following description applies to all of the figures.

The exemplary embodiment has a turbulence device 1 held on a chain-shaped support 13, so as to project, which device is enclosed by a cylindrical housing 2, in pot shape. For this purpose, the housing 2 is guided so as to be displaceable on the support 13, by way of two guide rods 25.1 and 25.2, through two guide openings 38.1 and 38.2. The guide rods 25.1 and 25.2 are attached to the housing 2 and penetrate the guide openings 38.1 and 382 with their free end. For manual guidance of the housing 2, a handle 26 is disposed on the outside of the housing 2, so that the housing 2 can be guided back and forth on the support 13 between a lay-down position and an operating position by an operator. In FIG. 5, the housing 1 is shown in the operating position, and in FIG. 6, it is shown in the lay-down position.

As is particularly evident from the representations in FIGS. 3 and 4, the turbulence device 1 in this exemplary embodiment is formed by a rotationally driven nozzle ring 15 that is guided on a stator 14. The stator 14 is attached to the support 13 and has a central bearing bore 20, in which a drive shaft 17 is mounted. The drive shaft 17 is coupled, with a free end, with the nozzle ring 15, which is guided on the stator 14 in pot shape. The opposite end of the drive shaft 17 is coupled with a drive 18.

The nozzle ring 15 has a circumferential guide groove 16, into which multiple radially oriented nozzle channels 8 open. The nozzle channels 8 penetrate the nozzle ring 15 and are alternately connected with a chamber opening 22 configured on the stator 14, as the nozzle ring 15 rotates. The chamber opening 22 opens into a pressure chamber 21 within the stator 14. The pressure chamber 21 is coupled with a compressed air source 33 by way of a compressed air connector 23.

The chamber opening 22 on the stator 14 has a cover 19 assigned to it on the support 13, which covers the guide groove 16 of the nozzle ring 15 and forms a treatment channel 11 together with the nozzle ring 15.

As is particularly evident from FIG. 3, the turbulence device 1 has two deflection pins 35.1 and 35.2 assigned to it for thread guidance, which pins are held on the support 13 so as to project from it. In this connection, the deflection pins 35.1 and 35.2 project into two notches 39.1 and 39.2 of the housing wall 2.1. The notches 39.1 and 39.2 are introduced into the housing wall 2.1, on the open face end 24 of the housing, opposite one another.

The notches 39.1 and 39.2 are structured in the housing wall 2.1 in the manner of a profile, and form a thread inlet 3 and an opposite thread outlet 4 in the housing wall 2.1. The thread inlet 3 is determined by the cross-section of the notch 39.1 and has a central recess 3.3 and two opening slots 3.1 and 3.2 that open into the recess 3.3. Likewise, the thread outlet 4 is formed by the cross-section of the notch 39.2, with a recess 4.3 and opening slots 4.1 and 4.2 that open into the recess 4.3 on the sides. The recesses 3.3 and 4.3 form the accommodations for the deflection pins 35.1 and 35.2. In this connection, the deflection pins 35.1 and 35.2 project into the recesses 3.3 and 4.3 in such a manner that the connection between the opening slots 3.1 and 3.2 as well as between the opening slots 4.1 and 4.2 is interrupted.

As is particularly evident from the representation in FIG. 4, the support 13 has a circumferential sealing groove 27 for accommodating the housing 2, into which groove the step-shaped face end 24 of the housing projects. The sealing groove 27 has a circumferential seal 28 assigned to it, which can be connected with a compressed air source 33 by way of a compressed air channel 29. The seal 28 can be inflated during operation, so that the seal 28 is braced between an inside flank of the housing wall 2.1 and the support 13.

A contact sensor 32 is assigned to the open face end 24 of the housing 2, which sensor is coupled with a control device 31. The control device 31 is coupled with a control valve 30 and with the drive 18 by way of control lines. The contact sensor 32, which could be a contact switch, for example, senses the position of the housing 2, so that activation of the compressed air source 33 and of the drive 18 is only possible in the operating position of the housing 2.

Furthermore, a suction opening 36 is configured on the support 13, which opens into the interior of the housing 2 and is connected with a suction device. In this case, the suction device is formed by a suction fan 37 that generates a continuous suction stream to remove excess air during operation of the apparatus.

In the exemplary embodiment of the apparatus according to the invention shown in FIGS. 3 to 6, in order to lay a thread into the turbulence device 1, the housing 2 is first brought into a lay-down position as shown in FIG. 6. The thread is threaded into the treatment channel 11 of the turbulence device 1 and deflected by way of the laterally guided deflection pins 35.1 and 35.2. The deflection pins 35.1 and 35.2 thereby form the incoming thread guide and the outgoing thread guide, in order to achieve defined looping of the thread on the circumference of the guide groove 16 of the nozzle ring 15. This situation is particularly shown in FIG. 3.

As soon as the lay-down procedure has been completed, the housing 2 is pushed into the operating position. This situation is shown in FIG. 5. When the operating position of the housing 2 is reached, a signal is sent to the control device 31, by way of the sensor 32, that the apparatus is ready for operation. The control device 31 generates control signals to connect the compressed air source 33 with the seal 28 and the pressure chamber 21 by way of the control valve 30. At the same time, the drive 18 could be controlled by way of the control device 31, in order to transfer the rotation of the nozzle ring 15 from a lay-down speed of rotation to an operating speed of rotation, for example.

When the housing 2 is shifted from the lay-down position into the operating position, the thread is guided into the notches 39.1 and 39.2 of the housing wall 1 with the deflection pins 35.1 and 35.2. Thereby the thread path at the thread inlet 3 and at the thread outlet 4 of the housing 2 is set automatically.

As is particularly evident from the representation in FIG. 3, transmission of air-borne sound from the interior of the housing 2 into the surroundings, through the opening slots 3.2 and 3.2 as well as 4.1 and 4.2 in the housing wall 2.1, which are offset, in each instance, is not possible. The sound waves can be deflected by means of the deflection pins 35.1 and 35.2, into the free space of the recesses 3.3 and 4.3, in each instance.

The exemplary embodiment shown in FIGS. 3 to 6 can be advantageously expanded in such a manner that the housing 2 has a mantling in the interior, which consists of an insulation material, in order to absorb air-borne sound within the housing. In this way, not only the bottom of the housing 2 but also the circumferential housing wall in the interior region can be lined with one or more layers of insulation material.

A further alternative for thread guidance can still be particularly implemented in that the deflection pins 35.1 and 35.2 are replaced with deflection rollers. Such deflection rollers possess the advantage that low-friction guidance of the thread 12, which is gentle on the thread, is possible during the turbulence treatment.

The exemplary embodiment shown in FIGS. 3 to 6 is therefore particularly suitable for treating a thread with compressed air streams generated in pulse-like manner. Generation by means of a nozzle ring that can be operated at the thread movement speed furthermore allows treatment of threads in processes during which the thread is guided at high thread speeds.

LIST OF REFERENCE SIGNS

1 turbulence device
2 housing
2.1 housing wall
3 thread inlet
3.1, 3.2 opening slot
3.3 recess
4 thread outlet
4.1, 4.2 opening slot
4.3 recess
5.1, 5.2 thread guide element
6 nozzle plate
7 baffle plate
8 nozzle channel
9 compressed air connector
10.1, 10.2 housing halves
11 treatment channel
12 thread
13 support
14 stator
15 nozzle ring
16 guide groove
17 drive shaft
18 drive
19 cover
20 bearing bore
21 pressure chamber
22 chamber opening
23 compressed air connector
24 open face end
25.1, 25.2 guide rods
26 handle
27 sealing groove
28 seal
29 compressed air channel
30 control valve
31 control device
32 contact sensor
33 compressed air source
35.1, 35.2 deflection pin
36 suction opening
37 suction fan
38.1, 38.2 guide opening
39.1, 39.2 notch

The invention claimed is:

1. Apparatus for treatment of a thread with compressed air, the apparatus comprising:

a turbulence device, and a housing that encapsulates the turbulence device with regard to the surroundings and that has a thread inlet and an opposite thread outlet, wherein at least one of the thread inlet and the thread outlet is formed by means of two consecutive, separate opening slots and a thread guide element between the opening slots, wherein the turbulence device has a driven nozzle ring that has at least one nozzle channel in a circumferential guide groove, which channel can be periodically connected with a compressed air feed and interacts with a stationary cover to form a treatment channel.

2. Apparatus according to claim 1, wherein the opening slots are configured in a housing wall that has a recess between the opening slots, into which recess the thread guide element projects.

3. Apparatus according to claim 1, wherein the opening slots and the thread guide element are disposed offset from one another, in such a manner that a thread is guided on the thread guide element with a partial loop.

4. Apparatus according to claim 1, wherein the thread inlet is formed by means of two consecutive, separate opening slots and a thread guide element between the opening slots, and wherein the thread guide element forming the thread inlet is directly arranged prior to the turbulence device, so as to form an incoming thread guide to the turbulence device.

5. Apparatus according to claim 1, wherein the turbulence device is disposed on a support and projects from the support, and wherein the housing is open on one side and encloses the turbulence device on the support, in the manner of a hood.

6. Apparatus according to claim 5, wherein the housing is guided on the support in displaceable manner, wherein the opening slots and a recess in the housing wall are open toward a face end that faces the support, and wherein the thread guide element is disposed on the support and can be inserted into the recess of the housing wall.

7. Apparatus according to claim 6, wherein the thread guide element of the thread inlet and the thread guide element of the thread outlet of the housing are held on the support.

8. Apparatus according to claim 5, wherein a sealing groove for sealing the housing is formed on the support and interacts with the face end of the housing.

9. Apparatus according to claim 8, wherein the sealing groove has an inflatable seal that can be filled with compressed air in an operating position of the housing and is braced between the support and the housing when inflated.

10. Apparatus according to claim 5, wherein a contact sensor is disposed on the support, which sensor interacts with the housing in an operating position of the housing and is connected with a control device.

11. Apparatus according to claim 1, wherein the thread guide element is formed by a deflection roller or a deflection pin.

12. Apparatus according to claim 1, wherein a suction opening is formed beside the turbulence device within the housing, which opening can be connected with a suction device.

13. Apparatus according to claim 1, wherein the housing has a lining of an insulation material on the inside.

14. Apparatus according to claim 1, wherein the thread outlet is formed by means of two consecutive, separate opening slots and a thread guide element between the opening slots, and wherein the thread guide element forming the thread outlet is directly arranged subsequent to the turbulence device, so as to form an outgoing thread guide to the turbulence device.

15. Apparatus for treatment of a thread with compressed air, the apparatus comprising:

a turbulence device, and a housing that encapsulates the turbulence device with regard to the surroundings and that has a thread inlet and an opposite thread outlet, wherein at least one of the thread inlet and the thread outlet is formed by means of two consecutive, separate opening slots and a thread guide element between the opening slots, wherein the turbulence device is disposed on a support and projects from the support, and wherein the housing is open on one side and encloses the turbulence device on the support, in the manner of a hood, wherein a sealing groove for sealing the housing is formed on the support and interacts with the face end of the housing, and wherein the sealing groove has an inflatable seal that can be filled with compressed air in an operating position of the housing and is braced between the support and the housing when inflated.

16. Apparatus for treatment of a thread with compressed air, the apparatus comprising:

a turbulence device, and a housing that encapsulates the turbulence device with regard to the surroundings and that has a thread inlet and an opposite thread outlet, wherein at least one of the thread inlet and the thread outlet is formed by means of two consecutive, separate opening slots and a thread guide element between the opening slots, wherein the turbulence device is disposed on a support and projects from the support, and wherein the housing is open on one side and encloses the turbulence device on the support, in the manner of a hood, and wherein a contact sensor is disposed on the support, which sensor interacts with the housing in an operating position of the housing and is connected with a control device.

* * * * *